US006024409A

United States Patent [19]

Collins

[11] Patent Number: 6,024,409

[45] Date of Patent: Feb. 15, 2000

[54] LATERAL ROCKING CHAIR

[76] Inventor: Christina E. Collins, 180 Summer St., Maynard, Mass. 01754

[21] Appl. No.: 09/209,611

[22] Filed: Dec. 11, 1998

[51] Int. Cl.[7] ..... A47C 3/02

[52] U.S. Cl. ..... 297/271.6; 297/258.1; 297/188.14

[58] Field of Search ..... 297/258.1, 271.6, 297/188.14, 314

[56] References Cited

U.S. PATENT DOCUMENTS

| | | | |
|---|---|---|---|
| 335,428 | 2/1886 | Clayton | 297/271.6 |
| 446,659 | 2/1891 | Bunker | 297/314 |
| 691,931 | 1/1902 | Bryan | 297/271.6 |
| 693,197 | 2/1902 | White | 297/271.6 |
| 3,117,327 | 1/1964 | Mathew | 297/188.14 X |
| 4,047,753 | 9/1977 | Uchida | 297/32 X |
| 4,079,991 | 3/1978 | Harris | 297/133 X |
| 4,500,062 | 2/1985 | Sandvik | 248/371 X |
| 5,234,251 | 8/1993 | Ayotte | 297/188.14 |
| 5,395,085 | 3/1995 | Mann | 248/311.2 X |
| 5,415,454 | 5/1995 | Fu-Tsung | 297/3 X |
| 5,720,516 | 2/1998 | Young | 297/188.18 X |
| 5,839,781 | 11/1998 | Knape | 297/258.1 |

*Primary Examiner*—Lynne H. Browne
*Assistant Examiner*—Brian H. Buck

[57] ABSTRACT

A lateral rocking chair is provided including a seat with at least one free edge for allowing a pair of legs of a user to hang thereover and depend downwardly. Also included is a back coupled to the seat and extending upwardly therefrom. Next provided is at least one leg coupled to and depending from the seat. At least one rocker has a bottom surface with an arcuate configuration. The rocker is coupled to the leg. The rocker resides in a laterally extending vertical plane which is in parallel with the back of the rocking chair for allowing lateral rocking about an axis that is normal to the back.

5 Claims, 2 Drawing Sheets

LATERAL ROCKING CHAIR

BACKGROUND OF THE INVENTION

1. Field of the Invention

The present invention relates to rocking chairs and more particularly pertains to a new lateral rocking chair for allowing a user to rock in a lateral direction while seated in an upright position.

2. Description of the Prior Art

The use of rocking chairs is known in the prior art. More specifically, rocking chairs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 56,718; U.S. Pat. No. 4,079,991; U.S. Pat. No. Des. 299,087; U.S. Pat. No. 5,702,152; U.S. Pat. No. Des. 360,314; and U.S. Pat. No. 13,478.

In these respects, the lateral rocking chair according to the present invention substantially departs from the conventional concepts and designs of the prior art, and in so doing provides an apparatus primarily developed for the purpose of allowing a user to rock in a lateral direction while seated in an upright position.

SUMMARY OF THE INVENTION

In view of the foregoing disadvantages inherent in the known types of rocking chairs now present in the prior art, the present invention provides a new lateral rocking chair construction wherein the same can be utilized for allowing a user to rock in a lateral direction while seated in an upright position.

The general purpose of the present invention, which will be described subsequently in greater detail, is to provide a new lateral rocking chair apparatus and method which has many of the advantages of the rocking chairs mentioned heretofore and many novel features that result in a new lateral rocking chair which is not anticipated, rendered obvious, suggested, or even implied by any of the prior art rocking chairs, either alone or in any combination thereof.

To attain this, the present invention generally comprises a seat with a planar square configuration having a planar top face, a planar bottom face, and a periphery formed therebetween. The periphery is defined by four equally sized edges. Also included is a back with a planar configuration having a horizontally oriented linear lower edge mounted along one of the edges of the seat and extending upwardly therefrom in perpendicular relationship therewith. The back further has a horizontally oriented linear upper edge with a length ½ that of the lower edge. As shown in FIG. 1, a pair of side edges of the back each have a vertically oriented lower extent and an inwardly tapering upper extent with a length greater than that of the lower extent. Formed centrally between the upper extent of the side edges is a cut out. With continuing reference to FIG. 1, a pair of arms each have a generally cylindrical inboard portion mounted along opposite edges of the seat. Each cylindrical inboard portion has a planar circular inboard face abutting the back, a concave circular outboard face, and a tubular periphery. As shown in FIG. 4, a plurality of linearly aligned vertically oriented bores are formed along a bottom edge of the periphery of the cylindrical inboard portion for receiving ribbed dowels therein. Such dowels are in turn inserted within linear aligned vertically oriented bores formed in the top face of the seat. Each of the arms further has a generally spherical outboard portion with a planar bottom extent and a spherical upper extent. The spherical upper extent of each outboard portion has a pair of vertically spaced horizontally oriented bores formed therein for receiving ribbed dowels therein which are in turn inserted within vertically spaced horizontally oriented bores formed in the outboard face of one of the arms. The outboard portion of at least one of the arms has a cylindrical recess formed therein for removably receiving a drinking container. Also included are four legs each having a generally cylindrical configuration. Ideally, each of the legs is equipped with a diameter which decreases from a top end thereof to a bottom end thereof. The top ends of the legs are coupled to the bottom face of the seat at corners thereof and depend therefrom in perpendicular relationship therewith. Finally, a pair of rockers each have a bottom surface with an arcuate configuration. A top surface of each rocker has a pair of ends with cylindrical indents for receiving the bottom ends of the legs. As such, a screw may be inserted through a countersunk aperture formed in the bottom surface of the corresponding rocker for attachment purposes. Lastly, the rockers reside in a pair of laterally extending vertical planes which are in parallel with the back of the rocking chair for allowing lateral rocking about an axis that is normal to the back.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lateral rocking chair apparatus and method which has many of the advantages of the rocking chairs mentioned heretofore and many novel features that result in a new lateral rocking chair which is not anticipated, rendered obvious, suggested, or even implied by any of the prior art rocking chairs, either alone or in any combination thereof.

It is another object of the present invention to provide a new lateral rocking chair which may be easily and efficiently manufactured and marketed.

It is a further object of the present invention to provide a new lateral rocking chair which is of a durable and reliable construction.

An even further object of the present invention is to provide a new lateral rocking chair which is susceptible of a low cost of manufacture with regard to both materials and labor, and which accordingly is then susceptible of low prices of sale to the consuming public, thereby making such lateral rocking chair economically available to the buying public.

Still yet another object of the present invention is to provide a new lateral rocking chair which provides in the apparatuses and methods of the prior art some of the advantages thereof, while simultaneously overcoming some of the disadvantages normally associated therewith.

Still another object of the present invention is to provide a new lateral rocking chair for allowing a user to rock in a lateral direction while seated in an upright position.

Even still another object of the present invention is to provide a new lateral rocking chair that includes a seat with at least one free edge for allowing a pair of legs of a user to hang thereover and depend downwardly. Also included is a back coupled to the seat and extending upwardly therefrom. Next provided is at least one leg coupled to and depending from the seat. At least one rocker has a bottom surface with an arcuate configuration. The rocker is coupled to the leg. The rocker resides in a laterally extending vertical plane which is in parallel with the back of the rocking chair for allowing lateral rocking about an axis that is normal to the back.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
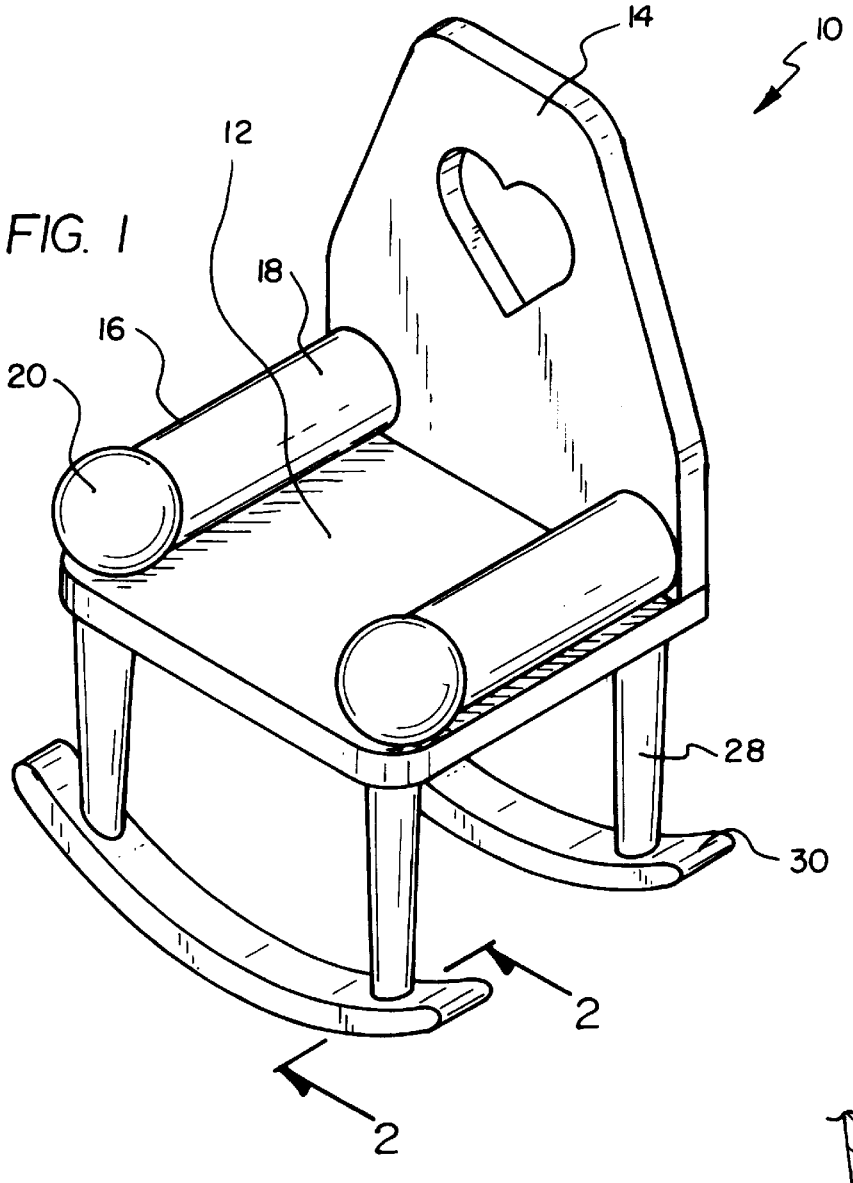
FIG. 1 is a perspective view of a new lateral rocking chair according to the present invention.
Figure 2:
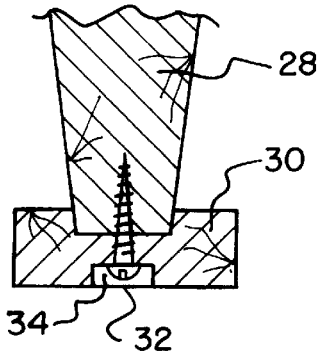
FIG. 2 is a cross-sectional view of the interconnection between one of the legs and one of the rockers of the present invention taken along line 2—2 of FIG. 1.
Figure 3:
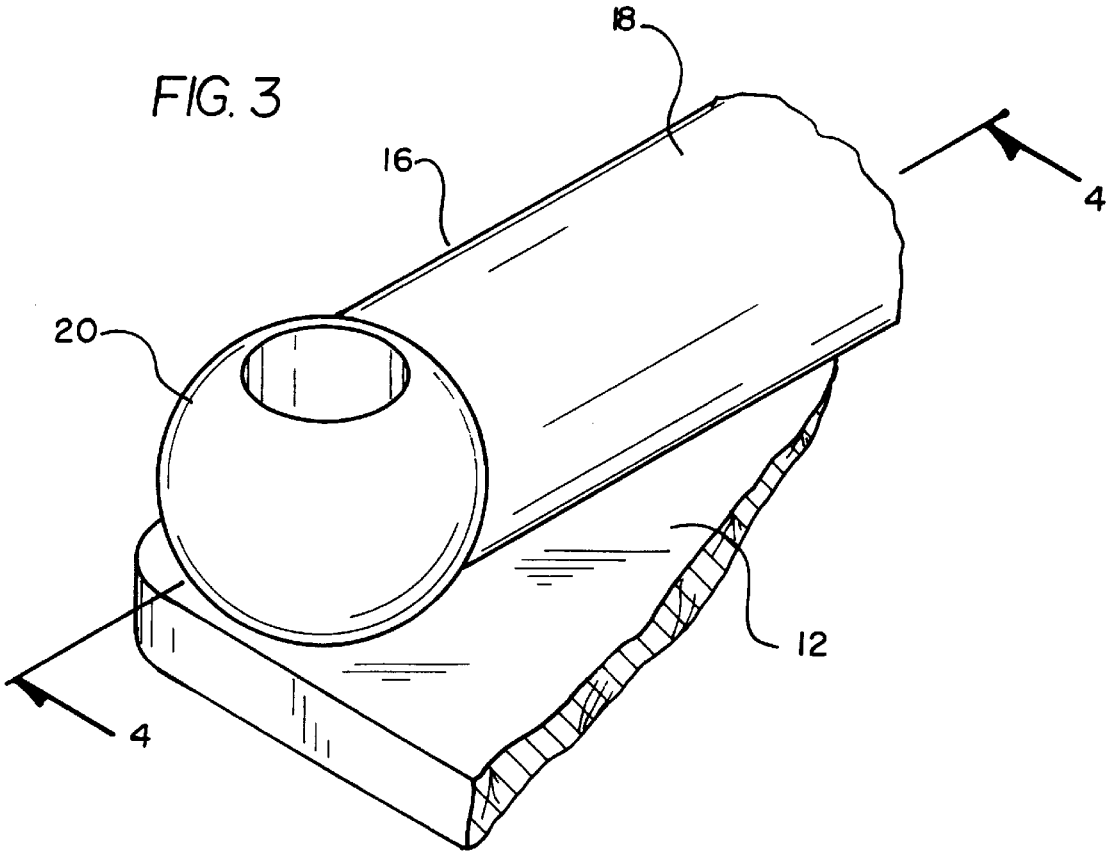
FIG. 3 is a detailed perspective view of one of the arms and seat of the present invention.

With reference now to the drawings, and in particular to FIGS. 1 through 4 thereof, a new lateral rocking chair embodying the principles and concepts of the present invention and generally designated by the reference numeral 10 will be described.

The present invention, designated as numeral 10, includes a seat 12 with a planar square configuration having a planar top face, a planar bottom face, and a periphery formed therebetween. The periphery is defined by four equally sized edges.

Also included is a back 14 with a planar configuration having a horizontally oriented linear lower edge mounted along one of the edges of the seat and extending upwardly therefrom in perpendicular relationship therewith. The back further has a horizontally oriented linear upper edge with a length ½ that of the lower edge. As shown in FIG. 1, a pair of side edges of the back each have a vertically oriented lower extent and an inwardly tapering upper extent with a length about twice that of the lower extent. Formed centrally between the upper extent of the side edges of the back is a cut out. Ideally, the back and the seat of the rocking chair each have a common uniform thickness. Further, a length between the upper and lower edges and a length between the lower extents of the side edges of the back are equal to a length and width dimension of the seat.

Figure 4:
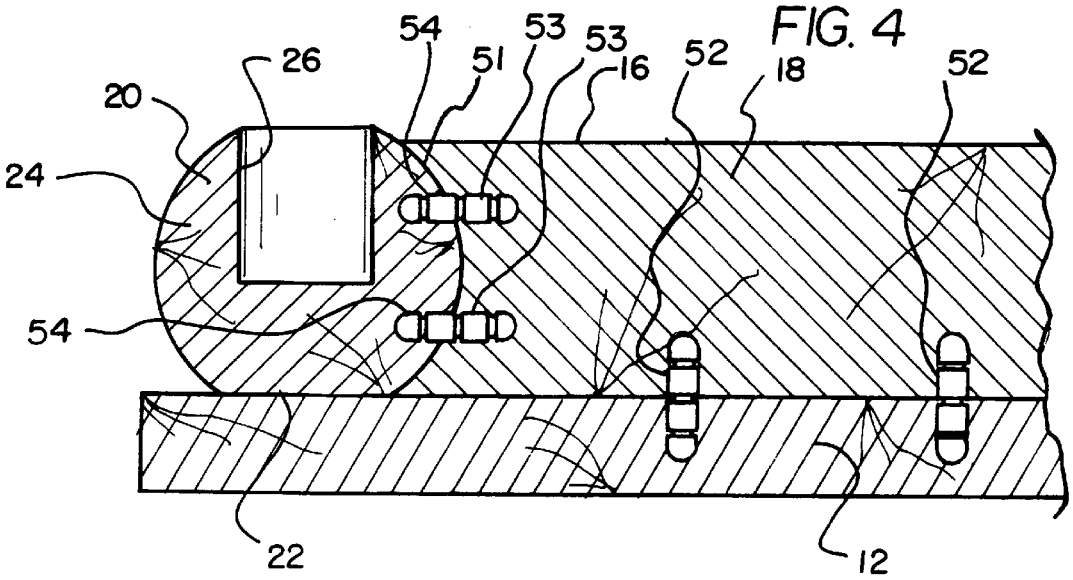
FIG. 4 is a cross-sectional view of the interconnection of the portions of the arm and the seat of the present invention taken along line 4—4 of FIG. 3.

With continuing reference to FIG. 1, a pair of arms 16 each have a solid generally cylindrical inboard portion 18 mounted along opposite edges of the seat. Each cylindrical inboard portion has a planar circular inboard face abutting the back, a concave circular outboard face, 51 and a tubular periphery. As shown in FIG. 4, a plurality of linearly aligned vertically oriented bores 52 are formed along a bottom edge of the periphery of the cylindrical inboard portion for receiving ribbed dowels therein. Such dowels are in turn inserted within linear aligned vertically oriented bores formed in the top face of the seat.

Each of the arms further has a solid generally spherical outboard portion 20 with a planar bottom extent 22 and a spherical upper extent 24. The spherical upper extent of each outboard portion has a pair of vertically spaced horizontally oriented bores 54 formed therein for receiving ribbed dowels therein which are in turn inserted within vertically spaced horizontally oriented bores 53 formed in the outboard face of one of the arms. The ribs of the dowels of the present invention are preferably defined by annular grooves formed therein. The outboard portion of at least one of the arms has a cylindrical recess 26 formed therein for removably receiving a drinking container. Ideally, a height of the outboard portion of each arm is greater than that of the cylindrical inboard portion.

Also included are four legs 28 each having a generally cylindrical configuration. Ideally, each of the legs is equipped with a diameter which decreases from a top end to a bottom end thereof. The top ends of the legs are coupled to the bottom face of the seat at corners thereof and depend therefrom in perpendicular relationship therewith.

Finally, a pair of rockers 30 each have a top and bottom surface each with an arcuate configuration. The rockers are shown in FIG. 1 to have a common thickness along a length thereof. A top surface of each rocker has a pair of ends with cylindrical indents 32 for receiving the bottom ends of the legs. As such, a screw 34 may be inserted through a countersunk aperture formed in the bottom surface of the corresponding rocker for attachment purposes.

Lastly and most importantly, the rockers reside in a pair of laterally extending vertical planes which are in parallel with the back of the rocking chair for allowing lateral rocking about an axis that is normal to the back of the rocking chair. Ideally, each of the foregoing components are constructed from a wood material.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A lateral rocking chair comprising, in combination:

a seat with a planar square configuration having a planar top face, a planar bottom face, and a periphery formed therebetween defined by four equally sized edges, wherein the seat has at least one free edge for allowing a pair of legs of a user to hang thereover and depend downwardly;

a back with a planar configuration having a horizontally oriented linear lower edge mounted along one of the edges of the seat opposite the free edge and extending upwardly therefrom in perpendicular relationship therewith, a horizontally oriented linear upper edge with a length ½ that of the lower edge, a pair of side edges each having a vertically oriented lower extent and an inwardly tapering upper extent with a length greater than that of the lower extent, and a cut out formed centrally between the upper extent of the side edges;

a pair of arms, each being generally cylindrical and having first and second ends, the arms being mounted along opposite edges of the seat, the first end of each cylindrical arm having a planar circular inboard face abutting the back, the second end of each arm having a concave circular outboard face, and a cylindrical periphery with a plurality of linearly aligned vertically oriented bores formed along a bottom edge thereof for receiving ribbed dowels therein which arc in turn inserted within linearly aligned vertically oriented bores formed in the top face of the seat, a generally spherical outboard member with a planar bottom extent and a spherical upper extent located at the outboard end of the arms, the spherical upper extent of each outboard member having a pair of vertically spaced horizontally oriented bores formed therein for receiving ribbed dowels therein which are in turn inserted within vertically spaced horizontally oriented bores formed in the outboard face of one of the arms, wherein the outboard member has a cylindrical recess formed therein for removably receiving a drinking container;

four legs each having a generally cylindrical configuration and a diameter which decreases from a top end thereof to a bottom end thereof, the top ends of the legs being coupled to the bottom face of the seat at corners thereof and depending therefrom in perpendicular relationship therewith; and a pair of rockers each having a bottom surface with an arcuate configuration and a top surface including a pair of ends with cylindrical indents for receiving the bottom ends of the legs such that a screw may be inserted through a countersunk aperture formed in the bottom surface of the corresponding rocker for attachment purposes;

wherein the rockers reside in a pair of laterally extending vertical planes which are in parallel with the back of the rocking chair for allowing lateral rocking about an axis that is normal to the back.

2. A lateral rocking chair comprising:

a seat with at least one free edge for allowing a pair of legs of a user to hang thereover and depend downwardly;

a back coupled to the seat opposite the free edge and extending upwardly therefrom;

at least one leg coupled to and depending from the seat; and at least one rocker having a bottom surface with an arcuate configuration, the rocker coupled to the leg;

a pair of arms each being generally cylindrical and having first and second ends, the arms being mounted along opposite edges of the seat, the first end of each cylindrical arm having a planar circular inboard face abutting the back, the second end of each arm having a concave circular outboard face and a cylindrical periphery, each arm having a plurality of linearly aligned vertically oriented bores formed along a bottom edge of each arm for receiving ribbed dowels which are in turn inserted within linearly aligned vertically oriented bores formed in the top face of the seat, each of the arms further having a generally spherical outboard member with a planar bottom extent and a spherical upper extent located at the outboard end of the arms, the spherical upper extent of each outboard member having a pair of vertically spaced horizontally oriented bores formed therein for receiving ribbed dowels which are in turn inserted within vertically spaced horizontally oriented bores formed in the outboard face of one of the arms; and wherein the rocker resides in a laterally extending vertical plane which is in parallel with the back of the rocking chair for allowing lateral rocking about an axis that is normal to the back.

3. The lateral rocking chair as set forth in claim 2 wherein the generally spherical outboard member has a cylindrical recess formed therein for containing a drinking cup.

4. The lateral rocking chair as set forth in claim 2 wherein the back has a cut out formed therein.

5. A lateral rocking chair comprising:

a seat having a top face, a bottom face, and a periphery formed therebetween, wherein the seat has at least one free edge adapted for allowing a pair of legs of a user to hang over the free edge when the user is positioned on the seat;

a back having a lower edge mounted along one of the edges of the seat opposite the free edge, the back extending upwardly from the seat;

a pair of arms each arm being mounted along opposite edges of the seat and having first and second ends, the first end of each arm having an inboard face abutting the back, the second end of each arm having an outboard face and a periphery, the periphery having a plurality of linearly aligned vertically oriented bores formed along a bottom edge of each arm for receiving ribbed dowels which are in turn inserted within linearly aligned vertically oriented bores formed in the top face of the seat, each of the arms further having an outboard member with a planar bottom extent and a spherical upper extent located at the outboard end of the arms, the spherical upper extent of each outboard member having a pair of vertically spaced horizontally oriented bores formed therein for receiving ribbed dowels which are in turn inserted within vertically spaced horizontally oriented bores formed in the outboard face of one of the arms, wherein the outboard member of at least one of the arms has a cylindrical recess formed therein for removably receiving a drinking container;

a plurality of legs, a top end of each of the legs being coupled to the bottom face of the seat;

a pair of rockers each having a bottom surface with an arcuate configuration and a top surface including a pair of ends with indents for receiving a bottom end of an associated one of the legs such that a screw may be inserted through an aperture formed in the bottom surface of the associated rocker for attachment of the rockers to the legs; and wherein the rockers are positioned in a pair of laterally extending vertical planes parallel to the back of the rocking chair for allowing lateral rocking about an axis that is normal to the back.

* * * * *